US006109764A

United States Patent [19]

Shu

[11] Patent Number: 6,109,764

[45] Date of Patent: Aug. 29, 2000

[54] LED LAMP AND POLARIZED SOCKET ASSEMBLY FOR DECORATIVE LAMP STRINGS

[76] Inventor: Kuo Fen Shu, No. 10, Lane 198, Chung Cheng Road, Hsinchu, Taiwan

[21] Appl. No.: 09/260,563

[22] Filed: Mar. 2, 1999

[51] Int. Cl.[7] ..... H01R 33/00

[52] U.S. Cl. ..... 362/226; 439/619; 439/699.2

[58] Field of Search ..... 362/226, 249, 362/806; 439/619, 699.2, 611

[56] References Cited

U.S. PATENT DOCUMENTS 5,988,830 11/1999 Huang ..... 362/226

*Primary Examiner*—Alan Cariaso
*Assistant Examiner*—Ronald DelGizzi
*Attorney, Agent, or Firm*—Rosenberg, Klein & Lee

[57] ABSTRACT

An LED lamp string is provided wherein the lamp base and socket have mutually engaging positioning devices to achieve polarization of the LED lamp with respect to the socket. Terminals of different sizes are installed into different sized grooves in the socket to polarize the electrical wires with respect to the socket.

2 Claims, 3 Drawing Sheets

LED LAMP AND POLARIZED SOCKET ASSEMBLY FOR DECORATIVE LAMP STRINGS

BACKGROUND OF THE INVENTION

To avoid the heat generated by incandescent lamps during usage, the decorative lamp string of the present invention utilizes an LED lamp to replace the conventional tungsten lamp, which provides utility and reduces the temperature of the lamps, saves energy and overcomes conventional difficulties. However, the LED lamp has electrodes with defined polarities, i.e. while assembling, locations of the connected plus and negative poles have to be correct, otherwise the lamp will not provide illumination.

SUMMARY OF THE INVENTION

Therefore, the main object of the present invention is to provide an LED lamp set having a positioning structure to be used for decorative strings or Christmas lamp strings. The present invention has positioning devices disposed between the lamp base and lamp socket, and mated with different distinguishable terminals to achieve the purpose of easy and precise lamp set assembly. Now, in connection with the drawings, the features and effectiveness of the present invention are described as follows:

DETAILED DESCRIPTION OF THE PREFERRED EMBODIMENT

Figure 1:
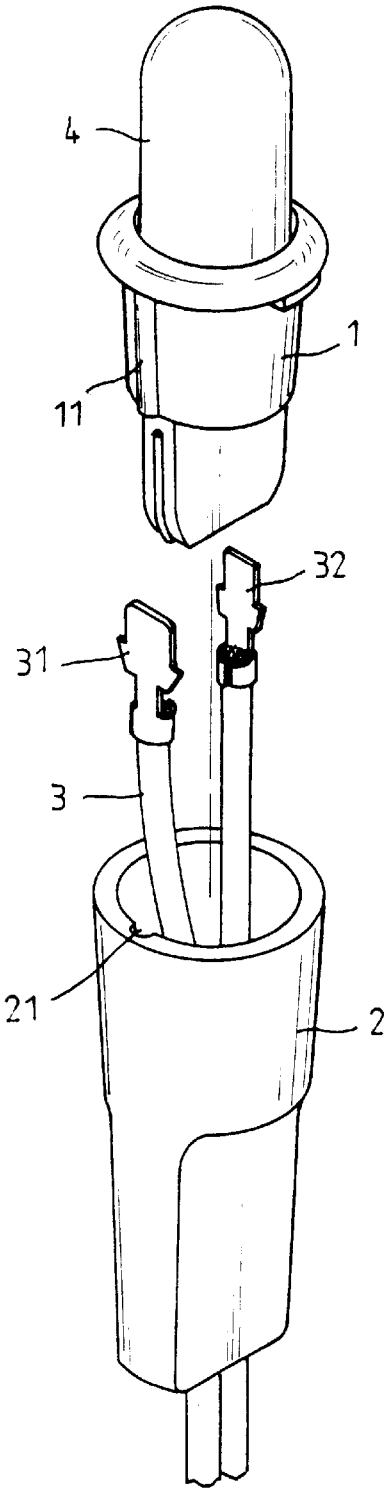
FIG. 1 is a three dimensional exploded view of the present invention.
Figure 2:
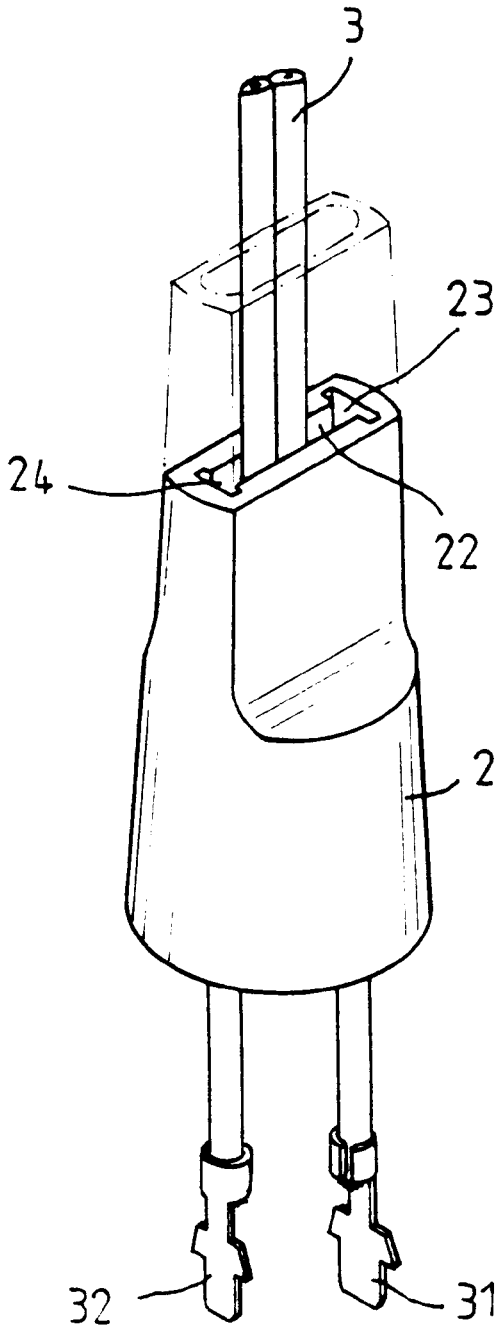
FIG. 2 is a three dimensional view of the lamp socket and terminals of electrical wires for another angle of the present invention.

As shown in FIGS. 1, 2, the present invention comprises a lamp base 1, a lamp socket 2, a set of electrical wires 3 and an LED lamp 4. One side face of the lamp base 1 is formed with a protruding rib 11 extending longitudinally on a substantially cylindrically shaped portion of the lamp base 1. A concave groove 21 is formed in an interior wall surface of the lamp socket 2 for engagement with the protruding rib 11 of lamp base 1, such that the lamp base 1 can be accurately assembled when the protruding rib 11 is aligned with the concave groove 21 of the lamp socket 2. Therefore, the present invention provides for manual assembly or use of auto-assembly machines, such that the lamp base 1 can be easily and precisely sleeved to the lamp socket 2, connecting with the LED lamp into an interior cavity of the lamp socket 2.

A bottom portion of the lamp socket 2 is formed with an open hole 22 which has larger and smaller positioning grooves 23, 24 set at two sides of the open hole 22. A pair of electrical wires 3 pass through the open hole 22, with larger and smaller terminals 31, 32 respectively coupled to the ends of the wires. Thus, the small terminal 32 can be inserted into the lamp socket 2 of the small positioning groove 24, and the large terminal 31 can be inserted into the large positioning groove 23 to provide precise connection of the wires 3 according to the polarity established by the different sized terminals 31, 32.

By providing the above-described positioning devices, anyone can quickly and precisely finish the assembly of the LED lamp set with simple care or the simple control of an automatic machine; and with the correct polarities of the lamp and wires to achieve the purpose of proper electrical conduction to illuminate the lamp string.

Figure 3:
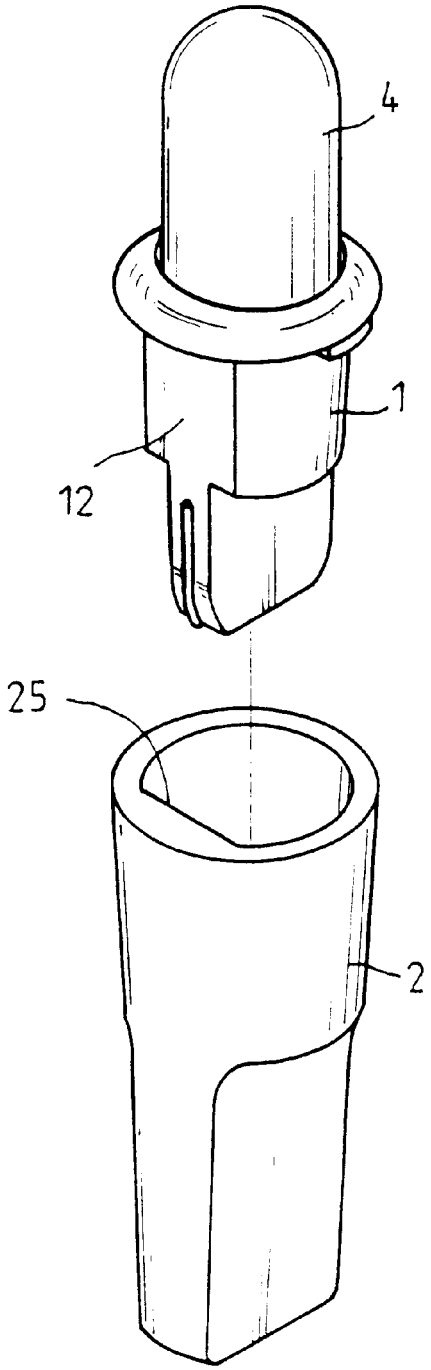
FIG. 3 is a three dimensional view of a variation of the present invention.

As shown in FIG. 3, the lamp base 1 of the present invention can be formed with one side having a flat surface 12. A corresponding portion of the lamp socket 2 is also formed with a flat surface 25 formed on an interior wall surface, such that the lamp base 1 and lamp socket 2 have a simple polarized engagement structure to obtain the desired assembly performance. Further, the lamp base and LED lamp have an integrated shape to simplify the assembly processes.

What is claimed is:

1. An LED lamp set for decorative lamp strings, comprising:

a lamp base having an LED lamp mounted therein, said lamp base having a substantially cylindrical portion with a longitudinally extended protruding rib formed thereon;

a pair of electrical wires, a first of said electrical wires having a first terminal coupled to an end thereof and a second of said pair of wires having a second terminal coupled to an end thereof, said second terminal being smaller than said first terminal; and, a socket having an interior cavity for receiving said lamp base therein, said interior cavity being circumscribed by an inner wall surface, said inner wall surface having a groove formed therein adjacent a first open end of said socket for mating with said protruding rib of said lamp base and limiting a position of said lamp base with respect to said socket to a single orientation, said socket having an opening formed in a second end thereof in open communication with said interior cavity, said opening having a pair of positioning grooves respectively formed at opposing ends of said opening, a first of said grooves being dimensioned for passage of said first terminal therethrough and a second of said grooves being dimensioned for passage of only said second terminal therethrough to thereby fix a position of said first and second terminals with respect to said lamp base orientation.

2. An LED lamp set for decorative lamp strings, comprising:

a lamp base having an LED lamp mounted therein, said lamp base having a substantially cylindrical portion with a longitudinally extended substantially flat surface portion formed thereon;

a pair of electrical wires, a first of said electrical wires having a first terminal coupled to an end thereof and a second of said pair of wires having a second terminal coupled to an end thereof, said second terminal being smaller than said first terminal; and, a socket having an interior cavity for receiving said lamp base therein, said interior cavity being circumscribed by an inner wall surface, said inner wall surface having a substantially flat surface portion adjacent a first open end of said socket for mating with said substantially flat surface portion of said lamp base and limiting a position of said lamp base with respect to said socket to a single orientation, said socket having an opening formed in a second end thereof in open communication with said interior cavity, said opening having a pair of positioning grooves respectively formed at opposing ends of said opening, a first of said grooves being dimensioned for passage of said first terminal therethrough and a second of said grooves being dimensioned for passage of only said second terminal therethrough to thereby fix a position of said first and second terminals with respect to said lamp base orientation.

* * * * *